US006739150B2

(12) United States Patent
Mompo Garcia

(10) Patent No.: US 6,739,150 B2
(45) Date of Patent: May 25, 2004

(54) PORTABLE ICEBOX

(75) Inventor: Jose Luis Mompo Garcia, Beneixida (ES)

(73) Assignee: Vidal Europa, S.A., Beneixida (ES)

( * ) Notice: Subject to any disclaimer, the term of this patent is extended or adjusted under 35 U.S.C. 154(b) by 0 days.

(21) Appl. No.: 10/122,411

(22) Filed: Apr. 16, 2002

(65) Prior Publication Data

US 2003/0024938 A1 Feb. 6, 2003

(30) Foreign Application Priority Data

Apr. 16, 2001 (ES) ..... 200100963

(51) Int. Cl.[7] ..... F25D 3/08

(52) U.S. Cl. ..... 62/457.7; 220/629; 220/757; 280/47.24; 280/646

(58) Field of Search ..... 62/457.7; 220/915.2, 220/592.2, 757, 761, 762, 764, 629; 280/47.24, 47.26, 645, 646

(56) References Cited

U.S. PATENT DOCUMENTS

| | | | | |
|---|---|---|---|---|
| 2,726,094 | A | * 12/1955 | Leystra | 280/646 |
| 4,314,624 | A | * 2/1982 | Royet | 190/18 A |
| 4,873,841 | A | * 10/1989 | Bradshaw et al. | 62/239 |
| 5,313,817 | A | * 5/1994 | Meinders | 62/457.1 |
| 5,373,708 | A | * 12/1994 | Dumoulin, Jr. | 62/457.7 |
| 5,465,985 | A | * 11/1995 | Devan et al. | 280/30 |
| 6,047,976 | A | * 4/2000 | Wang | 280/47.315 |
| 6,305,185 | B1 | * 10/2001 | Sloan | 62/457.7 |

* cited by examiner

*Primary Examiner*—William E. Tapolcai
(74) *Attorney, Agent, or Firm*—Jacobson Holman PLLC

(57) ABSTRACT

A portable icebox having on one of the longer sides of the icebox body, a telescopic or unfolding extendable handle made of a number of joined sections, housed inside vertical cavities in the body of the icebox. When folded, the handle is housed inside the cavities and held by a transverse fitting element on the base of the icebox, preventing it from being fully released, and with the crosspiece for use of the icebox still protruding when the handle is folded.

3 Claims, 2 Drawing Sheets

PORTABLE ICEBOX

FIELD OF THE INVENTION

The present invention relates to thermal coolers containing ice to conserve food and keep soft drink, fruit and other items cool for camping or the beach.

BACKGROUND OF THE INVENTION

The portable icebox, filled with ice, food, drink, can and the like, carried manually, represents an added effort of great difficulty, and major improvements have ben added making it structural and constituent features differ significantly from portable iceboxes known at present.

SUMMARY OF THE INVENTION

Essentially, the improved portable icebox has, apart from the conventional body and top, at the base, close to one of the longer sides, a set of two folding wheels which can be concealed, operated manually by the user, making it possible to pull it along: on the other longer side, there is a type of unfolding handle, which may or may not be telescopic, used to move the icebox when extended and which can be folded flush with the icebox when it is to be put away and transported.

Similarly, on one of the ends, this icebox can incorporate an extendable handle with a retracting system incorporating tensing springs at the handle base or around the extendable bar fitted to the handle, arranged so as to tend to keep the handle retracted and the user must pull it out, tensing the spring so that when the handle is released, it folds up under the action of the spring or springs inside the icebox.

BRIEF DESCRIPTION OF THE DRAWINGS

For a better grasp of the general features described above, drawings are attached which show, in graphic and diagrammatic form, a practical design for this improved portable icebox: it is pointed out that, given the eminently informative nature of the drawings, the figures there should be examined with the very broadest criteria and without any limitation.

The figures in the attached drawings show the following.

DETAILED DESCRIPTION OF THE PREFERRED EMBODIMENTS

In all cases with reference to the attached drawings, it can be pointed out that the figures incorporate numerical references with the following descriptions of the features and operation, making it easy to locate them immediately:—1—is the body of the icebox, with the hermetic seal top—2—to conserve the cold, the body—1—of the icebox has an unfolding or telescopic extractable handle—3—on one of the longer sides, the bottom of which fits inside the enclosure—4—of the icebox body—1—by means of the transverse point—5—, so that it cannot be removed when pulled from the icebox The extendable handle—3—has a number of unfolding parts—6—making it possible to reach the height required for ease of handling.

Figure 1:
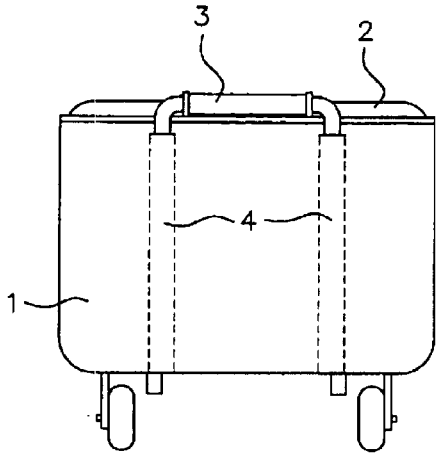
FIG. 1.—Rear elevation of the new improved portable icebox showing the arrangement of the retractable handle, here folded for storage and transport.
Figure 3:
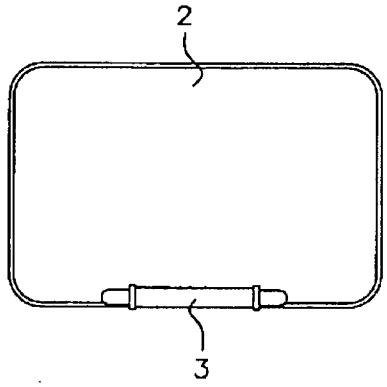
FIG. 3.—An upper face view of the portable icebox with its cover and, on one of the longer sides, the extractable handle for handling and movement.
Figure 2:
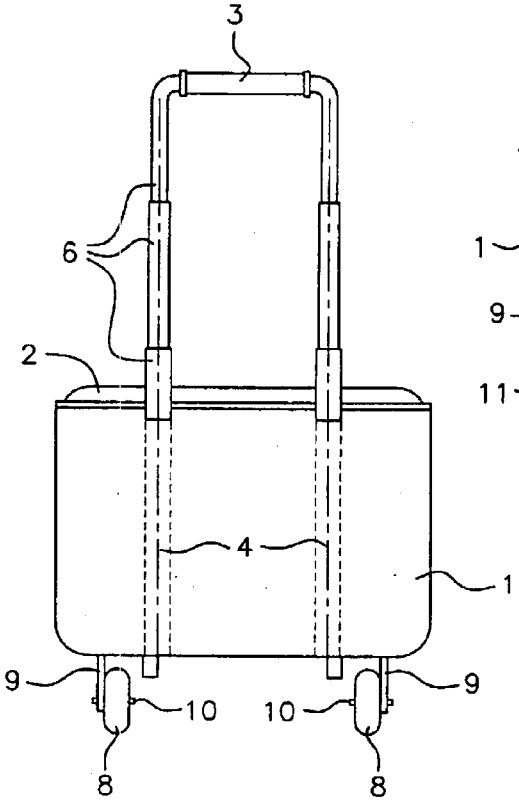
FIG. 2.—The same rear elevation as in FIG. 1, showing the handle unfolded telescopically or in any of the possible forms, at the base of the portable icebox revealing the wheels which can be unfolded manually by the user making it easier to transport the icebox with a load inside by pulling on the handle, supported on the wheels in the bottom of the icebox.
Figure 4:
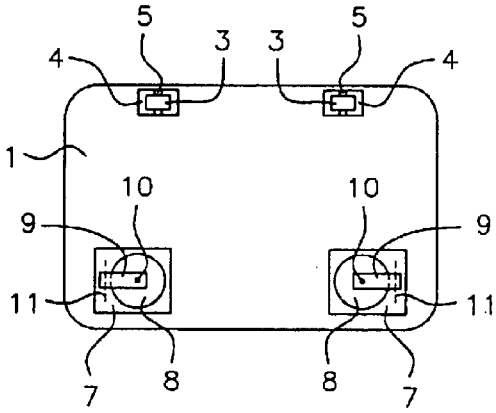
FIG. 4.—A face view of the portable icebox from below, showing the placement of the folding wheels in their compartments, and the arrangement on the longer side opposite of the extractable or unfolding telescopic handle, attached the icebox by conventional means at this lower point.
Figure 5:
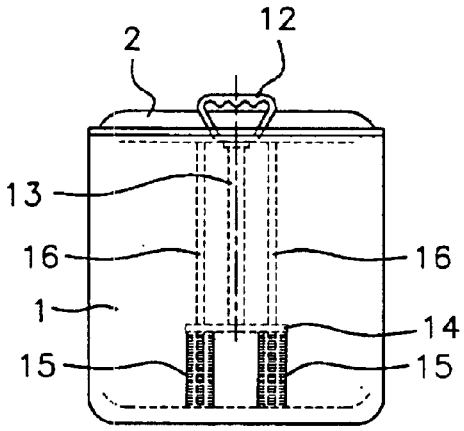
FIG. 5.—An external transverse elevation of the portable icebox, with a retractable type extendable handle which, in this case, has two tensing springs applying a withdrawal action on a slide with guides from which the handle to pull the icebox emerges.
Figure 6:
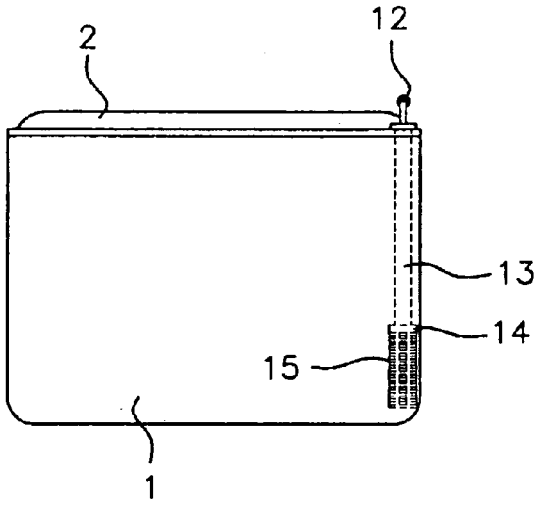
FIG. 6.—An external lengthwise elevation view of the icebox with the retractable handle incorporated in the folded position.
Figure 7:
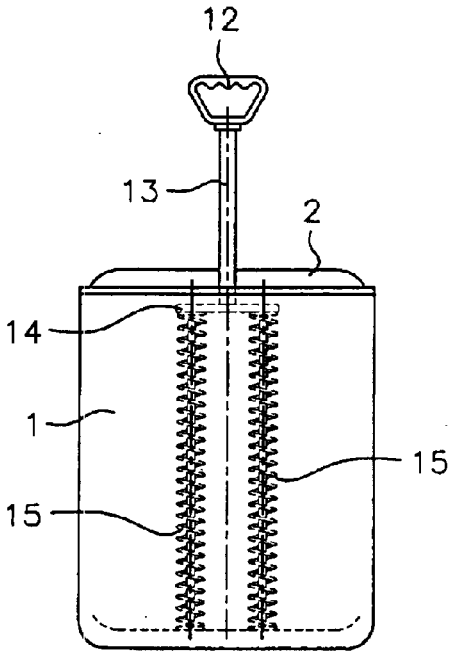
FIG. 7.—The same external transverse elevated view as in FIG. 5 showing the handle in the extended position for handling the portable icebox, where the withdrawal springs remain extended and tensed while the user em ploys the handle.
Figure 8:
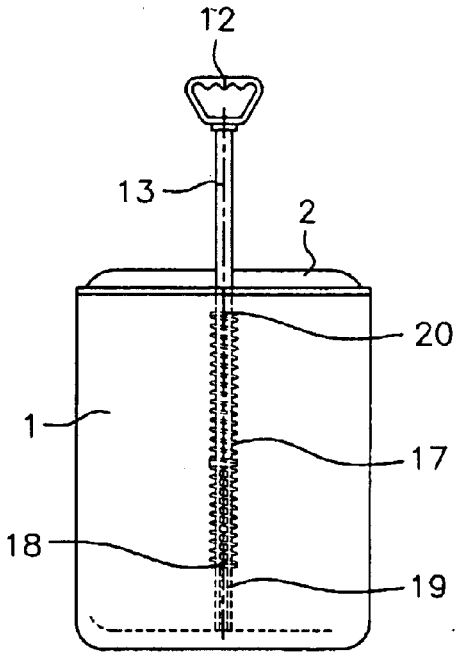
FIG. 8.—A transverse elevated view of the portable icebox with the handle out, tensing a withdrawal spring around the pincer which ends on the handle for the movement of the icebox.

On the bottom or lower side of the icebox body—1—there are compartments—7—along one of the longer sides opposite to that housing the extractable handle and inside which are the folded wheels—8—which can rotate freely; said wheels are secured to the support flanges at point—11—in the bottom of the icebox body—1—, so that they can swivel to be removed and positioned as shown in FIG. 2 to facilitate movement of the portable icebox by pulling the extractable handle—3—with the rotation and support of the wheels—8—extracted in full and running on the ground.

Another useful procedure permitting the handling of the improved portable icebox which is the subject of the invention is the use of the manually secured handle—12—of anatomical form, with said handle—12—fitted to the extendable bar—13—on the transverse slide—14—on which the traction springs rest—15—fixed to the bottom of the icebox, running along an inside point and with the slide—14—running between the guide rods—16—arranged vertically. As well, a single retracting spring can be incorporated—17—, around the extendable retractable bar—13—, that spring—17—secured at the bottom end—18—to the fixed bush—19—fitted onto the body—1—of the icebox while, at the top, it is fixed at point—20—to the extendable retractable bar—13—, tending to hold the handle folded against the icebox.

All the parts of the improved portable icebox which are the subject of this invention are considered to have been amply described and it remains only to indicate that said parts may be made in a variety of materials, sizes, shapes and colours, and constructive variations can also be added to the design should practice make that advisable, and provided that this does not alter the essential point of which this application is the subject.

What is claimed is:

1. A portable icebox comprising an icebox body having a top, a base, two opposing short sides and two opposing long sides, an extendable handle located on one of the two long sides and extending perpendicular to the base of the body and housed inside at least one vertical cavity in the body so that, when collapsed, the handle is housed inside said at least one vertical cavity and held by a transverse fitting element on the base of the body, preventing the handle from being fully released, two compartments spaced and recessed in the base of the body along the other of the two long sides of the body, each of the two compartments including four side walls, and a set of only two freely rotating wheels fitted by rotating shafts to flange-like mounts fitted on a support in a bottom of the respective compartments where the wheels are housed, each of the wheels being surrounded by the four sidewalls of each of the two compartments respectively, so that a plane containing a diameter the two wheels lies parallel to the bade of the body in a position of rest, the wheel being swivelled and independently extracted from the compartments to rotate about an axis extending parallel to the base of the body in a position of use with the plane containing the diameter of each of the two wheels extends parallel to the two opposing short sides so that the icebox can be moved along on the freely rotating wheels when the handle on the one of the two long sides and extending perpendicular to the base of the body is grasped and pulled.

2. The portable icebox as claimed in claim 1, wherein the handle is U-shaped, having two legs and a crosspiece, the legs each having a plurality of telescoping parts and the crosspiece lying along one of the other of the two long sides of the body when the handle is in a retracted position.

3. The portable icebox as claimed in claim 2, wherein there are two vertical cavities for housing the two legs of the handle.

* * * * *